US011479827B2

(12) United States Patent
Santori

(10) Patent No.: US 11,479,827 B2
(45) Date of Patent: Oct. 25, 2022

(54) SPIKED PLATE AND RELATIVE PLATE PRESS MACHINE AND PROCESS FOR WORKING NATURAL LEATHER

(71) Applicant: CONCERIA NUVOLARI SRL, Montegiorgio (IT)

(72) Inventor: Sara Santori, Montegiorgio (IT)

(73) Assignee: Conceria Nuvolari SRL, Montegiorgio (IT)

( * ) Notice: Subject to any disclaimer, the term of this patent is extended or adjusted under 35 U.S.C. 154(b) by 287 days.

(21) Appl. No.: 16/650,341

(22) PCT Filed: Oct. 2, 2018

(86) PCT No.: PCT/IB2018/057633

§ 371 (c)(1),
(2) Date: Mar. 24, 2020

(87) PCT Pub. No.: WO2019/069221

PCT Pub. Date: Apr. 11, 2019

(65) Prior Publication Data

US 2021/0198759 A1 Jul. 1, 2021

(30) Foreign Application Priority Data

Oct. 3, 2017 (IT) ..... 102017000110296

(51) Int. Cl.
*C14B 5/02* (2006.01)
*A43D 8/04* (2006.01)
(Continued)

(52) U.S. Cl.
CPC ..... *C14B 5/02* (2013.01); *A43D 8/04* (2013.01); *A43D 8/18* (2013.01); *C14B 1/56* (2013.01); *C14B 2700/116* (2013.01)

(58) Field of Classification Search
CPC ..... C14B 5/02; C14B 1/56; C14B 2700/116; C14B 5/00; A43D 8/04; A43D 8/18
See application file for complete search history.

(56) References Cited

U.S. PATENT DOCUMENTS 5,184,487 A * 2/1993 Corner ..... C14B 1/40 69/19.1
5,269,814 A * 12/1993 Schmidt ..... C14B 1/00 8/94.2
2016/0186274 A1* 6/2016 Zhou ..... B29C 45/1418 69/21

FOREIGN PATENT DOCUMENTS

DE 102004039956 A1 * 2/2006 ..... B32B 38/06
DE 102004039956 A1 2/2006
(Continued)

OTHER PUBLICATIONS

International Search Report for application PCT/IB2018/057633, dated Oct. 2, 2018, 2 pages.

*Primary Examiner* — Khoa D Huynh
*Assistant Examiner* — Erick I Lopez
(74) *Attorney, Agent, or Firm* — Loza & Loza, LLP

(57) ABSTRACT

Spiked plate (100) having an operating surface provided with a plurality of conical spikes (200), configured to penetrate into an inner side of a full grain natural leather having a thickness t and make blind holes in said inner side of the full grain natural leather, wherein:—a base diameter d of the conical spikes (200) ranges from 33% to 100% of the thickness t, whereby $0.33 \cdot t \leq d \leq t$,—a height h of the conical spikes (200) ranges from 70% to 110% of the thickness t, whereby $0.7 \cdot t \leq h \leq t$, and—a minimum distance D between the conical spikes (200) on the operating surface of the spiked plate (100) ranges from 200% to 430% of the thickness t, whereby $2 \cdot t \leq D \leq 4.3 \cdot t$.

13 Claims, 1 Drawing Sheet

Figure 1:
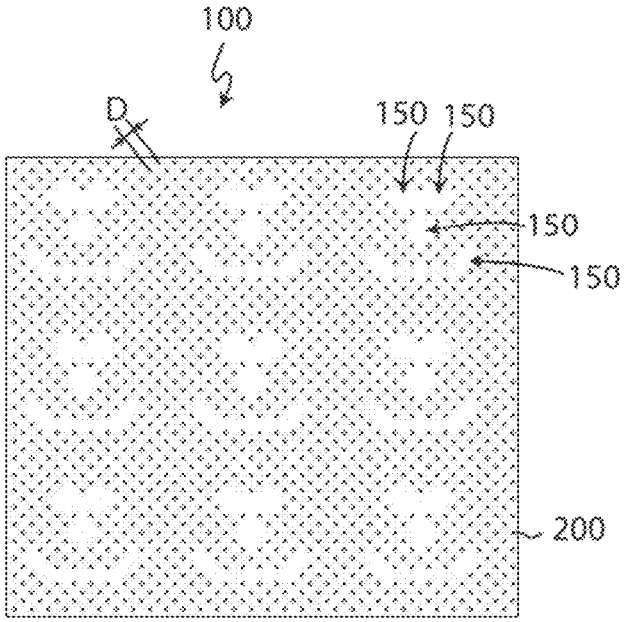

(51) Int. Cl.
*A43D 8/18* (2006.01)
*C14B 1/56* (2006.01)

(56) References Cited

FOREIGN PATENT DOCUMENTS

| | | | |
|---|---|---|---|
| FR | 2028705 | A1 | 10/1970 |
| GB | 619388 | A | 3/1949 |
| JP | H02218800 | A | 8/1990 |

* cited by examiner

SPIKED PLATE AND RELATIVE PLATE PRESS MACHINE AND PROCESS FOR WORKING NATURAL LEATHER

The present invention relates to a spiked plate, the relative plate press machine and the relative processing for working natural leather, allowing in a simple, efficient, reliable and economical way to obtain leather having a high breathability without altering its aesthetic look, thereby allowing having an elegant and customizable design.

It is known that many wearable products such as shoes, bags, gloves and clothing, as well as other products that go into contact with the body of a user, such as sofas and cars seats, are made in natural leather, i.e. animal skin, mainly goatskin or calfskin, but also cattles and bulls leather.

As is known, the skin of the animals which is used in the tanning industry is made of three layers: the epidermis (i.e. the outer layer, usually having hair), the dermis (the intermediate layer) and the meat (the inner layer that adheres to the body of the animal). In the early stages of the working of natural leather, the epidermis and the meat are removed. The dermis comprises one papillary layer facing the epidermis, called "full grain", and a reticular layer facing the meat, said "flesh split". For products made of natural leather the full grain of the animal skin is used; in particular, the full grain can also be subdivided into two (or more) layers, wherein the outermost layer (i.e. closest to the epidermis) is the one having higher quality.

However, products made of natural leather, especially wearable products, have the disadvantage of not allowing a sufficient perspiration, therefore they are uncomfortable when used (e.g., when worn) for a long time.

In order to improve the wellness of a user that uses for a very long time a leather product, some prior art solutions use a perforated natural leather which is provided with a plurality of through holes allowing perspiration, e.g. as described in documents WO 2005/011417 A2, WO 2012/171003 A1, WO 2017/029356 A1 and US 2017/0088909 A1. In such prior art solutions, the full grain of the skin undergoes a process of mechanical drilling that is carried out by making holes from the external side (i.e. the one facing toward the epidermis) of the full grain. Document DE 10 2004 039956 A1, instead, teaches to obtain a plurality of blind holes in the outer side (i.e. the side that remains visible, during the normal use of a corresponding finial product) of a material such as leather, thereby providing a perforated look to the material but guaranteeing impermeability to water and humidity. In this case, also, the material undergoes a process of mechanical puncture which is carried out by obtaining the blind holes starting from the outer side (i.e. the side that remains visible, during the normal use of a corresponding finial product) of the material.

However, also these prior art solutions have disadvantages, mainly due to the fact that the perforation of the natural leather, i.e. the plurality of holes, is usually visible to the observer during the normal use of the product made of perforated natural leather, which perforated natural leather constitutes for example a lining of a glove, a bag, a garment, a sofa or a car seat, or an upper of a shoe. Accordingly, these prior art solutions alter the aesthetics of the product guaranteed by the continuity of the surface of the natural leather.

The object of the present invention is therefore to allow in a simple, efficient, reliable and economical way to have a natural leather having a high breathability while maintaining unchanged its aesthetic look.

A specific object of the present invention is formed by a spiked plate having an operating surface provided with a plurality of conical spikes, configured to penetrate into an inner side of a full grain natural leather having a thickness t and make blind holes in said inner side of the full grain natural leather, wherein:

- a base diameter d of the conical spikes ranges from 33% to 100% of the thickness t, whereby $0.33 \cdot t \leq d \leq t$,
- a height h of the conical spikes ranges from 70% to 110% of the thickness t, whereby $0.7 \cdot t \leq h$—t, and
- a minimum distance D between the conical spikes on the operating surface of the spiked plate ranges from 200% to 430% of the thickness t, whereby $2 \cdot t \leq D \leq 4.3 \cdot t$.

According to another aspect of the invention, the base diameter d of the conical spikes can range from 50% to 75% of the thickness t whereby $0.5 \cdot t \leq d \leq 0.75 \cdot t$, optionally ranges from 50% to 60% of the thickness t whereby $0.5 \cdot t \leq d \leq 0.6 \cdot t$, more optionally can be equal to 55% of the thickness t whereby $d = 0.55 \cdot t$.

According to a further aspect of the invention, the height h of the conical spikes can range from 90% to 105% of the thickness t whereby $0.9 \cdot t \leq h \leq 1.05 \cdot t$, optionally is not higher than the thickness t whereby $h \leq t$, more optionally ranges from 95% to 100% of the thickness t, whereby $0.95 \cdot t \leq h \leq t$, still more optionally can be lower than the thickness t whereby $h < t$.

According to an additional aspect of the invention, the minimum distance D between the conical spikes on the operating surface of the spiked plate can range from 250% to 375% of the thickness t whereby $2.5 \cdot t \leq D \leq 3.75 \cdot t$, optionally ranges from 275% to 325% of the thickness t whereby $2.75 \cdot t \leq D \leq 3.25 \cdot t$, more optionally can be equal to 300% of the thickness t whereby $D = 3 \cdot t$.

According to another aspect of the invention, the spiked plate can have a mounting surface opposite to the operating surface that is configured to be coupled, optionally in a removable way, to a plate press machine.

Yet a process for working natural leather forms a specific object of the present invention, the process comprising a step of piercing a sheet of full grain natural leather, having an inner side and an outer side, and a thickness ranging from 0.8 millimetres to 1.5 millimetres, through a spiked plate as described above, having an operating surface provided with a plurality of conical spikes to penetrate an inner side of a full grain natural leather for a number of times ranging from one to three, for a press duration ranging from 1 second to 4 seconds, with a pressure ranging from 15 to 60 atmospheres, and wherein the spiked plate is at a temperature ranging from 30° C. to 110° C., whereby the conical spikes make blind holes on the inner side of the full grain natural leather.

According to a further aspect of the invention, the operating surface of the spiked plate can be caused to press the inner side of the full grain natural leather once.

According to an additional aspect of the invention, the press duration can range from 1 second to 3 seconds, optionally equal to 3 seconds, wherein in the case where the operating surface of the spiked plate is caused to press the sheet of full grain natural leather at least twice, the press duration optionally changes from one press to the other.

According to another aspect of the invention, at each press the pressure can range from 17 to 40 atmospheres, optionally ranges from 19 to 30 atmospheres, more optionally can be equal to 20 atmospheres.

According to a further aspect of the invention, the spiked plate (100) can be at a temperature ranging from 60° C. to 100° C., optionally ranging from 85° C. to 95° C., more optionally can be equal to 90° C.

According to an additional aspect of the invention, the thickness of the sheet of full grain natural leather can range from 0.9 millimetres to 1.2 millimetres, optionally ranges from 0.95 millimetres to 1.1 millimetres, more optionally can be equal to 1.0 millimetre.

A specific object of the present invention is still formed by a plate press machine configured to carry out the process for working natural leather described above, having a spiked plate as previously described.

According to another aspect of the invention, the spiked plate can be mounted on a stationary element, operating as anvil, and wherein a hydraulic piston can be provided with a work table configured to receive a sheet of full grain natural leather to be pierced, having an inner side and an outer side, wherein the hydraulic piston is movable between a bottom position and a top position, and wherein, when a sheet of full grain natural leather is resting on the work table of the hydraulic piston with the inner side of the full grain facing the anvil, the spiked plate can be at a temperature ranging from 30° C. to 110° C. and the hydraulic piston approaches the top position, the sheet of the full grain natural leather comes into contact with the conical spikes of the spiked plate and the conical spikes make blind holes on the inner side of the full grain natural leather.

The spiked plate, the relative plate press machine and process for working the natural leather according to the invention offer numerous advantages.

First of all, the spiked plate, the plate press machine and the working process according to the invention allow to obtain a natural leather having high breathability without the need to alter the aesthetic look of the natural leather, which thus maintains an elegant design.

Furthermore, the spiked plate and the relative working process according to the invention allow to have a customizable design on the inner side (i.e. the one facing the meat) of the full grain of the natural leather that is used in leather products, in some of which (usually wearable products, e.g. shoes, bags, gloves and clothing) this inner side is visible to the user (even though it remains hidden to outside observers when the user wears the leather product).

Figure 2:
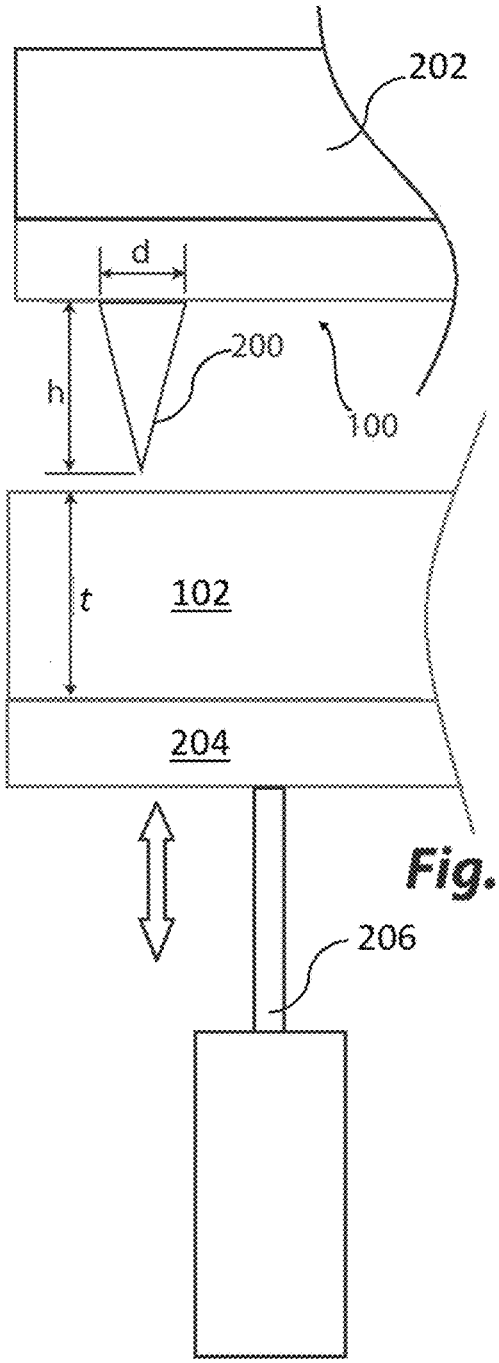

The present invention will be now described, for illustrative but not limiting purposes, according to its preferred embodiments, with particular reference to the Figures in the accompanying drawings, wherein:

FIG. 1 shows a plan view of the operating surface of a preferred embodiment of the spiked plate according to the invention; and FIG. 2 shows a side view of a spike of the plate of FIG. 1.

In the Figures the same reference numerals will be used for similar elements.

With reference to FIG. 1, the operating surface of a preferred embodiment of the spiked plate 100 according to the invention can be seen. The operating surface is provided with a plurality of conical spikes 200, one of which is shown in FIG. 2. The operating surface of the spiked plate 100 is that facing the full grain in the process of working the natural leather according to the invention, which will be described in more detail below, whereby the conical spikes 200 come into contact with the full grain of the natural leather. The conical spikes 200 are advantageously all equal with each other. The surface of the spiked plate 100 opposite to the operating surface is coupled, optionally removably, to a plate press machine (not shown) performing the process of working the natural leather according to the invention, whereby in the following of the present description and the claims it is indicated as a mounting surface.

The spikes 200 of the preferred embodiment of the spiked plate 100 are advantageously rigidly coupled to the plate 100. It must be considered that in other embodiments the conical spikes 200 may be removably coupled to the plate 100 (e.g., the spikes 200 can be provided with a threaded head which can be screwed into a corresponding threaded hole of the plate 100).

With reference to FIG. 2, in the preferred embodiment of the spiked plate 100, the base diameter d of the conical spikes 200 is equal to 0.55 mm and the height h of the conical spikes 200 is equal to 1.05 millimetres, while the minimum distance D between the conical spikes 200 on the operating surface of the spiked plate 100 (shown in FIG. 1) is equal to 3.00 mm. To this regard, the dimensions of the conical spikes 200 and of their mutual distance are obviously subject to the usual tolerances, optionally equal to a mechanical tolerance of 0.05 millimetres.

The dimensions of the conical spikes 200 and of their mutual distance depend on the thickness (shown by "t") of the natural leather 102 that the spiked plate 100 is configured to pierce. In particular, the process for working the natural leather according to the invention pierces the natural leather with the spiked plate 100 from the inner side of the full grain (i.e. the one facing the meat) so as not to perforate the outer surface of the full grain (i.e. the surface facing the epidermis), whereby the spiked plate 100 generates blind holes (i.e. holes that are not through holes) on the natural leather; the spiked plate 100 of FIG. 1 is configured to generate blind holes on a natural leather whose thickness t is optionally equal or close to 1.00 millimetres, more optionally is not lower than the height h of the conical spikes 200, still more optionally is higher than the height h of the conical spikes 200.

In other embodiments, the spiked plate 100 according to the invention is configured to generate blind holes on a natural leather having a thickness t (that can range from 0.8 millimetres to 5 millimetres, optionally ranges from 0.9 millimetres to 1.2 millimetres, more optionally ranges from 0.95 mm to 1.1 mm, still more optionally is equal to 1.0 millimetre), in which:

- the base diameter d of the conical spikes 200 ranges from 33% to 100% (i.e. $0.33 \cdot t \leq d \leq t$), optionally ranges from 50% to 75% (i.e. $0.5 \cdot t \leq d \leq 0.75 \cdot t$), more optionally ranges from 50% to 60% (i.e. $0.5 \cdot t \leq d \leq 0.6 \cdot t$), still more optionally ranges from 50% to 55% (i.e. $d = 0.55 \cdot t$) of the thickness t of the natural leather,
- the height h of the conical spikes 200 ranges from 70% to 110% (i.e. $0.7 \cdot t \leq h \leq 1.1 \cdot t$), more optionally ranges from 90% to 105% (i.e. $0.9 \cdot t \leq h \leq 1.05 \cdot t$), more optionally is not higher than the thickness t of the natural leather (i.e. $h \leq t$), still more optionally ranges from 95% to 100% (i.e. $0.95 \cdot t \leq h \leq t$) of the thickness t of the natural leather, even more optionally lower than the thickness t of the natural leather (i.e. $h < t$), and
- the minimum distance D between the conical spikes 200 on the operating surface of the spiked plate 100 ranges from 200% to 430% (i.e. $2 \cdot t \leq D \leq 4.3 \cdot t$), optionally ranges from 250% to 375% (i.e. $2.5 \cdot t \leq D \leq 3.75 \cdot t$), more optionally ranges from 275% to 325% (i.e. $2.75 \cdot t \leq D \leq 3.25 \cdot t$), still more optionally ranges from 50% to 300% (i.e. $D = 3 \cdot t$) of the thickness t of the natural leather, obviously taking into account mechanical tolerances.

By way of example and not by way of limitation, in the case wherein the natural leather to be pierced has a thickness t equal to 1.1 mm, the spiked plate 100 can have conical spikes 200 having a base diameter d equal to 0.80 millimetres, height h equal to 1.20 millimetres, and minimum distance D between the conical spikes 200 on the operating surface of the spiked plate 100 equal to 3.5 millimetres.

As shown in FIG. 1, the arrangement of the conical spikes 200 defines a repeated piercing pattern which will be executed on the natural leather through the spaces 150 devoid of conical spikes 200. Obviously, in other embodiments of the spiked plate according to the invention, the piercing pattern can be different form that shown in FIG. 1 for the preferred embodiment of the spiked plate 100.

The spiked plate 100 according to the invention can be mounted into a plate press machine, optionally a machine press such as for example the hydraulic press MP3-6-7TS (belonging to the family of MPTSX models) available from the Italian company Mostardini, by coupling (optionally removably) the mounting surface of the spiked plate 100 to the press, which performs the process for working natural leather.

The preferred embodiment of the process for working the natural leather comprises the step of drilling a sheet of full grain natural leather, by making the conical spikes 200 of the operating surface of the spiked plate 100 penetrate into the inner side of the full grain (i.e. that facing the meat), wherein the spiked plate 100 is at a temperature of 90° C., and wherein the sheet of full grain natural leather, which is optionally goatskin, has a thickness ranging from 0.8 mm to 1.5 mm, optionally ranging from 0.9 millimetres to 1.2 millimetres, more optionally ranging from 0.95 millimetres to 1.1 millimetres, still more optionally equal to 1.0 millimetre. The operating surface of the spiked plate 100 is made to press the sheet of flower of full grain natural leather for one time, with a pressure equal to 20 atmospheres, for a press duration equal to 3 seconds.

Unlike prior art teachings, the working process according to the invention does not completely pierce the sheet of full grain natural leather from the inner side of the full grain (i.e. the one facing the meat), instead of from the outer side of the full grain (i.e. that facing toward the epidermis), thus maintaining the continuity of the outer surface (i.e. the one facing the epidermis) of the sheet of full grain natural leather that is visible in the products then made of natural leather.

In fact, thanks to the size of the conical spikes 200 of the spiked plate 100, the outer surface of the full grain (i.e. the surface facing the epidermis) is not perforated, and the temperature of the spiked plate 100 and the relative conical spikes 200, generates a uniform micro-cooking (i.e. a localized cooking) of the walls of each blind hole thus obtained, which uniform micro-cooking does not cause the puncture of that outer surface of the full grain of the natural leather.

It must be kept in mind that other embodiments of the process for working the natural leather according to the invention, possibly also based on the thickness of the sheet of full grain natural leather and the hardness thereof, may require a different temperature of the spiked plate 100, which ranges from 30° C. to 110° C., optionally ranges from 60° C. to 100° C., more optionally ranges from 85° C. to 95° C., and/or the operating surface of the spiked plate 100 can press on the sheet of full grain natural leather even more than once (obviously, in this case it is necessary to ensure that at each pressing the conical spikes 200 of the operating surface of the spiked plate 100 always enter the same blind holes of the sheet of full grain natural leather), optionally for not more than three times, and/or with a pressure which ranges from 15 to 60 atmospheres, optionally ranges from 17 to 40 atmospheres, more optionally ranges from 19 to 30 atmospheres, and/or for a press duration (optionally changing from one pressing to the other, in the case wherein the operating surface of the spiked plate 100 is pressed on the sheet of full grain natural leather for at least twice) ranging from 1 second to 4 seconds, optionally ranging from 1 second to 3 seconds. In general, the lower is the temperature of the spiked plate 100, the higher is the number of times in which the operating surface of the spiked plate 100 is pressed on the sheet of full grain natural leather and/or the higher is the pressure.

By way of example and not by way of limitation, other embodiments of the process of working natural leather according to the invention may have the spiked plate 100 at a temperature of 90° C., and the operating surface of the spiked plate 100 is pressed twice on the sheet of full grain natural leather with a pressure equal to 20 atmospheres, for a press duration equal to 2 seconds, the first time, and equal to 1 second, the second time.

In particular, in the case wherein the process for working the natural leather according to the invention is performed by a plate press machine similar to the hydraulic press MP3-6-7TS made available from the Italian company Mostardini, the spiked plate according to the invention (optionally having dimensions of 1370×1000 millimetres) is mounted on the upper fixed element, operating as an anvil 202, while the sheet of full grain natural leather to be pierced is placed on the work table 204 of the lower hydraulic piston 206 with the inner side of the full grain (i.e. the one facing the meat) facing toward the anvil, while the outer side of the full grain (i.e. the one facing toward the epidermis) rests on the work table of the lower hydraulic piston. The lower hydraulic piston is movable between a bottom position and a top position: when the lower hydraulic piston approaches the top position, the sheet of the full grain natural leather comes into contact with the conical spikes of the spiked plate which generate the blind holes on the inner side of the full grain. In order to avoid that the outer side of the full grain is damaged, the sheet of the full grain natural leather can be supported, instead of directly into contact with the work table of the lower hydraulic piston, on a sheet of black rubber SP, which can optionally be positioned in turn on a sheet of medium density fibreboard or MDF (Medium-density fibreboard), so as to cushion the impact of the spiked plate on the inner side of the full grain. Advantageously, the stroke of the lower hydraulic piston, in particular the height of its top position can be adjusted so as to adapt the execution of the process according to the invention, to the thickness of the sheet of full grain of natural leather and the height h of the conical spikes of the spiked plate.

Other embodiments of the plate press machine according to the invention can have the spiked plate mounted onto the upper movable piston and a lower anvil provided with a work table wherein the sheet of the full grain natural leather to be pierced is placed.

As said, the working process of natural leather according to the present invention enables to make blind holes on the inner side of the full grain natural leather, which is not visible during normal use of leather products, thus obtaining a high breathability of the full grain natural leather, also thanks to the density of the blind holes, while maintaining unchanged the aesthetic look of the outer side of the flower of natural leather, which instead is visible during the normal use of the leather products.

In the foregoing the preferred embodiments were described and some modifications of this invention have been suggested, but it should be understood that those skilled in the art can make modifications and changes without departing from the relative scope of protection, as defined by the appended claims.

The invention claimed is:

1. Process for working natural leather comprising:

piercing a sheet of full grain natural leather, the sheet of full grain natural leather having an inner side, an outer side, and a thickness t ranging from 0.8 millimetres to 1.5 millimetres, through a spiked plate having an operating surface provided with a plurality of conical spikes, the conical spikes configured to penetrate said inner side of said full grain natural leather and to make blind holes on said inner side of said full grain natural leather, wherein:

a base diameter d of the conical spikes ranges from 33% to 100% of the thickness t, whereby $0.33 \cdot t \leq d \leq t$, a height h of the conical spikes ranges from 70% to 110% of the thickness t, whereby $0.7 \cdot t \leq h \leq t$, and a minimum distance D between the conical spikes on the operating surface of the spiked plate ranges from 200% to 430% of the thickness t, whereby $2 \cdot t \leq D \leq 4.3 \cdot t$, causing the operating surface of the spiked plate to press the inner side of the full grain natural leather for a number of times ranging from one to three, for a press duration ranging from 1 second to 4 seconds, with a pressure ranging from 15 to 60 atmospheres, and wherein the spiked plate is at a temperature ranging from 30° C. to 110° C., whereby the blind holes made by the conical spikes on the inner side of the full grain natural leather keep the overall aesthetic of the outer side of the full grain natural leather unchanged, and improve breathability from the inner side to the outer side of said full grain natural leather; and incorporating at least part of said sheet of full grain natural leather in at least one leather product having an inner surface that is not visible during normal use of said at least one leather product, and an outer surface that is visible during the normal use of said at least one leather product, wherein said inner surface corresponds to the inner side of said at least part of said sheet of full grain natural leather and said outer surface corresponds to the outer side of said at least part of said sheet of full grain natural leather.

2. Process according to claim 1, wherein the operating surface of the spiked plate is caused to press the inner side of the full grain natural leather once.

3. The process according to claim 1, wherein the press duration ranges from 1 second to 3 seconds, optionally is equal to 3 seconds, wherein in the case where the operating surface of the spiked plate is caused to press the sheet of full grain natural leather at least twice the press duration optionally changes from one pressing to the other.

4. Process according to claim 1, wherein at each pressing the pressure ranges from 17 to 40 atmospheres, optionally ranging from 19 to 30 atmospheres, more optionally is equal to 20 atmospheres.

5. Process according to claim 1, wherein the spiked plate is at a temperature ranging from 60° C. to 100° C., optionally ranging from 85° C. to 95° C., more optionally equal to 90° C.

6. Process according to claim 1, wherein the thickness of the sheet of full grain natural leather ranges from 0.9 millimetres to 1.2 millimetres, optionally ranging from 0.95 millimetres to 1.1 millimetres, more optionally is equal to 1.0 millimetre.

7. Spiked plate having an operating surface provided with a plurality of conical spikes, configured to penetrate into a full grain natural leather, said sheet of full grain natural leather having an inner side, an outer side, and a thickness t ranging from 0.8 millimetres to 1.5 millimetres, and to make blind holes in said inner side of the full grain natural leather, characterised in that:

a base diameter d of the conical spikes ranges from 33% to 100% of the thickness t, whereby $0.33 \cdot t \leq d \leq t$, a height h of the conical spikes ranges from 70% to 110% of the thickness t, whereby $0.7 \cdot t \leq h \leq t$, and a minimum distance D between the conical spikes on the operating surface of the spiked plate ranges from 200% to 430% of the thickness t, whereby $2 \cdot t \leq D \leq 4.3 \cdot t$; and wherein at least part of said sheet of full grain natural leather is incorporated in at least one leather product having an inner surface that is not visible during normal use of said at least one leather product, and an outer surface that is visible during the normal use of said at least one leather product, wherein said inner surface corresponds to the inner side of said at least part of said sheet of full grain natural leather and said outer surface corresponds to the outer side of said at least part of said sheet of full grain natural leather.

8. Spiked plate according to claim 7, wherein the base diameter d of the conical spikes ranges from 50% to 75% of the thickness t whereby $0.5 \cdot t \leq d \leq 0.75 \cdot t$, optionally ranges from 50% to 60% of the thickness t whereby $0.5 \cdot t \leq d \leq 0.6 \cdot t$, more optionally is equal to 55% of the thickness t whereby $d = 0.55 \cdot t$.

9. Spiked plate according to claim 7, wherein the height h of the conical spikes ranges from 90% to 105% of the thickness t whereby $0.9 \cdot t \leq h \leq 1.05 \cdot t$, optionally is not higher than the thickness t whereby $h \leq t$, more optionally ranges from 95% to 100% of the thickness t, whereby $0.95 \cdot t \leq h \leq t$, still more optionally is lower than the thickness t whereby $h \leq t$.

10. Spiked plate according to claim 7, wherein the minimum distance D between the conical spikes on the operating surface of the spiked plate ranges from 250% to 375% of the thickness t whereby $2.5 \cdot t \leq D \leq 3.75 \cdot t$ , optionally ranges from 275% to 325% of the thickness t whereby $2.75 \cdot t \leq D \leq 3.25 \cdot t$, more optionally is equal to 300% of the thickness t whereby $D = 3 \cdot t$.

11. Spiked plate according to claim 7, having a mounting surface opposite to the operating surface that is configured to be coupled, optionally removably, to a plate press machine.

12. Plate press machine configured to execute the process for working natural leather comprising:

piercing a sheet of full grain natural leather, the sheet of full grain natural leather having an inner side, an outer side, and a thickness t ranging from 0.8 millimetres to 1.5 millimetres, through a spiked plate;

wherein the spiked plate has an operating surface provided with a plurality of conical spikes, the conical spikes configured to penetrate said inner side of said full grain natural leather and to make blind holes on said inner side of said full grain natural leather, wherein:

a base diameter d of the conical spikes ranges from 33% to 100% of the thickness t, whereby $0.33 \cdot t \leq d \leq t$, a height h of the conical spikes ranges from 70% to 110% of the thickness t, whereby $0.7 \cdot t \leq h \leq t$, and a minimum distance D between the conical spikes on the operating surface of the spiked plate ranges from 200% to 430% of the thickness t, whereby $2 \cdot t \leq D \leq 4.3 \cdot t$; and wherein the process causes the operating surface of the spiked plate to press the inner side of the full grain natural leather for a number of times ranging from one to three, for a press duration ranging from 1 second to 4 seconds, with a pressure ranging from 15 to 60 atmospheres, and wherein the spiked plate is at a temperature ranging from 30° C. to 110° C., whereby the blind holes made by the conical spikes on the inner side of the full grain natural leather keep the overall aesthetic of the outer side of the full grain natural leather unchanged and improve breathability from the inner side to the outer side of said full grain natural leather; and wherein the process incorporates at least part of said sheet of full grain natural leather in at least one leather product having an inner surface that is not visible during normal use of said at least one leather product, and an outer surface that is visible during the normal use of said at least one leather product, wherein said inner surface corresponds to the inner side of said at least part of said sheet of full grain natural leather and said outer surface corresponds to the outer side of said at least part of said sheet of full grain natural leather.

13. Plate press machine according to claim 12, wherein the spiked plate is mounted on a stationary element, operating as anvil, and wherein a hydraulic piston is provided with a work table configured to receive a sheet of full grain natural leather to be pierced, having an inner side and an outer side, wherein the hydraulic piston can be moved between a bottom position and a top position, and wherein, when a sheet of full grain natural leather is resting on the work table of the hydraulic piston with the inner side of the full grain natural leather facing the anvil, the spiked plate is at a temperature ranging from 30° C. to 110° C. and the hydraulic piston approaches the top position, the sheet of the full grain natural leather comes into contact with the conical spikes of the spiked plate and the conical spikes make blind holes on the inner side of the full grain natural leather.

* * * * *